US006253574B1

(12) United States Patent
Stockmann et al.

(10) Patent No.: US 6,253,574 B1
(45) Date of Patent: Jul. 3, 2001

(54) METHOD FOR LIQUEFYING A STREAM RICH IN HYDROCARBONS

(75) Inventors: Rudolf Stockmann, Buchloe; Wolfgang Forg, Icking; Manfred Bolt, Olching; Manfred Steinbauer, Geretsried; Christian Pfeiffer, Gauting, all of (DE); Pentti Paurola, Hafrsfjord (NO); Arne Olav Fredheim; Oystein Sorensen, both of Trondheim (NO)

(73) Assignees: Linde Aktiengesellschaft, Wiesbaden (DE); Den Norske Stats Oljeselskap A.S., Stavanger (NO)

( * ) Notice: Subject to any disclaimer, the term of this patent is extended or adjusted under 35 U.S.C. 154(b) by 0 days.

(21) Appl. No.: 09/403,103

(22) PCT Filed: Apr. 15, 1998

(86) PCT No.: PCT/EP98/02198

§ 371 Date: Mar. 24, 2000

§ 102(e) Date: Mar. 24, 2000

(87) PCT Pub. No.: WO98/48227

PCT Pub. Date: Oct. 29, 1998

(30) Foreign Application Priority Data

Apr. 18, 1997 (DE) ..... 197 16 415

(51) Int. Cl.[7] ..... F25J 1/00; F25B 7/00

(52) U.S. Cl. ..... 62/612; 62/335; 62/913

(58) Field of Search ..... 62/606, 611, 612–912, 62/913, 335

(56) References Cited

U.S. PATENT DOCUMENTS 4,755,200 * 7/1988 Liu et al. ..... 62/612
5,611,216 * 3/1997 Low et al. ..... 62/612
5,669,234 * 9/1997 Houser et al. ..... 62/612

FOREIGN PATENT DOCUMENTS

3521060 * 12/1985 (DE) .
895094 5/1962 (GB) .
1208196 10/1970 (GB) .
1208196 * 10/1990 (GB) .

* cited by examiner

*Primary Examiner*—William Doerrler
(74) *Attorney, Agent, or Firm*—Millen, White, Zelano & Branigan, P.C.

(57) ABSTRACT

The invention relates to a method for liquefying a stream rich in hydrocarbons, especially a stream of natural gas, by the indirect exchange of heat with the refrigerants in a closed-circuit cascade of mixed refrigerants. According to the invention, said closed-circuit cascade of mixed refrigerants consists of at least 3 circuits of mixed refrigerants, with each circuit comprising different refrigerants. The first of the three mixed refrigerant circuits is used for pre-cooling (E1), the second for liquefying E2), and the third for super-cooling (E3) the hydrocarbon-rich stream (1) to be liquefied. The method provided for in the invention reduces specific energy consumption and investment costs since the three circuits of mixed refrigerants are or can be optimally adjusted to the enthalpy temperature curves of the hydrocarbon-rich stream to be liquefied and the refrigerant mixtures.

18 Claims, 5 Drawing Sheets

METHOD FOR LIQUEFYING A STREAM RICH IN HYDROCARBONS

The invention relates to a, process for liquefying a hydrocarbon-rich stream, in particular a natural gas stream, by indirect heat exchange with the refrigerants of a mixed-refrigerant cascade cycle.

Pretreatment steps for the hydrocarbon-rich stream which may be necessary prior to the liquefaction, such as removal of acid gas and/or mercury, removal of aromatic components, etc. which are not subject-matter of the present invention, are not considered in detail below.

Currently, most base load LNG plants are designed as what are known as dual-flow refrigeration processes. In this case, the refrigeration energy required for liquefying the hydrocarbon-rich stream or the natural gas is provided by two separate mixed-refrigerant cycles which are connected to form one mixed-refrigerant cascade cycle. A liquefaction process of this type is disclosed, for example, by GB-B 895 094.

In addition, liquefaction processes are known, in which the refrigeration energy required for the liquefaction is provided by a refrigerant cascade cycle, but not, however, a mixed-refrigerant cascade cycle; see, for example, LINDE-Berichte aus Technik und Wissenschaft, Issue 75/1997, pages 3–8. The refrigerant cascade cycle described therein consists of a propane or propylene refrigeration cycle, an ethane or ethylene refrigeration cycle and a methane refrigeration cycle. Although this refrigerant cascade cycle can be considered as energetically optimized, it is comparatively complicated because of the 9 compressor stages.

In addition, liquefaction processes are known, as described, for example, in DE-B 19 60 301, in which the refrigeration energy required for the liquefaction is provided by a cascade consisting of a mixed-refrigerant cycle and a propane precooling cycle.

The object of the present invention is to specify a process for liquefying a hydrocarbon-rich stream, in particular a natural gas stream, which has a reduced specific energy consumption in comparison with dual-flow refrigeration processes of this type and thus makes it possible to implement a smaller plant size and, associated therewith, makes possible lower capital costs.

This object is achieved according to the invention by means of the fact that the mixed-refrigerant cascade cycle consists of at least 3 mixed-refrigerant cycles having different refrigerant compositions.

In the process according to the invention—known as triple-flow mixed-refrigerant cycle—the mixed-refrigerant cascade cycle consists of at least three separate mixed-refrigerant cycles. These have different refrigerant compositions, since they must produce refrigeration at different temperatures.

The first of the three mixed-refrigerant cycles—known as the Precooling Refrigerant Cycle (PRC)—serves for the cooling and partial or complete condensation of the mixed refrigerants required for the liquefaction and subcooling and for the precooling of the hydrocarbon-rich stream. The second mixed-refrigerant cycle—known as the Liquefaction Refrigerant Cycle (LRC)—serves for the partial or complete condensation of the mixed refrigerant required for the subcooling and the condensation of the hydro-carbon-rich stream. The third mixed-refrigerant cycle—known as the Subcooling Refrigerant Cycle (SRC)—serves for the necessary subcooling of the liquefied hydrocarbon-rich stream.

According to a further advantageous development of the process according to the invention, the refrigerant used for the first of the three mixed-refrigerant cycles is a mixture of ethylene or ethane, propane and butane. This PRC mixed-refrigerant cycle serves for providing refrigerant in a temperature range from ambient temperature to between approximately −35 and approximately −55° C. According to a further development of the process according to the invention, the refrigerant used for the second of the three mixed-refrigerant cycles is a mixture of methane, ethylene or ethane and propane. For the third of the three mixed-refrigerant cycles, the refrigerant preferably used is a mixture of nitrogen, methane and ethylene or ethane. While the second or LRC mixed-refrigerant cycle provides refrigeration energy in a temperature interval from approximately −40 to approximately −100° C., the third or SRC mixed-refrigerant cycle serves for providing refrigeration to between approximately −85 and approximately −160° C.

The process procedure according to the invention leads to a reduction of the specific energy consumption and of the capital costs, since the three mixed-refrigerant cycles are optimally adapted, or can be adapted, to the enthalpy-temperature graphs of the hydrocarbon-rich stream to be liquefied and of the mixed refrigerants. Owing to this process procedure which is more efficient in comparison with a dual-flow refrigeration process, either the liquefaction plant required may be decreased in size and thus the costs of the plant may be decreased, or the capacity of the hydrocarbon-rich stream to be liquefied can be increased with the plant size remaining the same.

BRIEF DESCRIPTION OF DRAWINGS

The process according to the invention and other developments of the same may now be described in more detail with reference to FIGS. 1 to 5 which are flowsheets of embodiments of the invention.

In the process according to the invention, the refrigerant required for liquefying the hydrocarbon-rich stream is provided by at least three mixed-refrigerant cycles. For the sake of clarity, in FIGS. 1 to 5, a "P", "L" or "S" for PRC, LRC or SRC mixed-refrigerant cycle is placed in front of each of the reference numbers for the individual mixed-refrigerant cycles.

Figure 1:
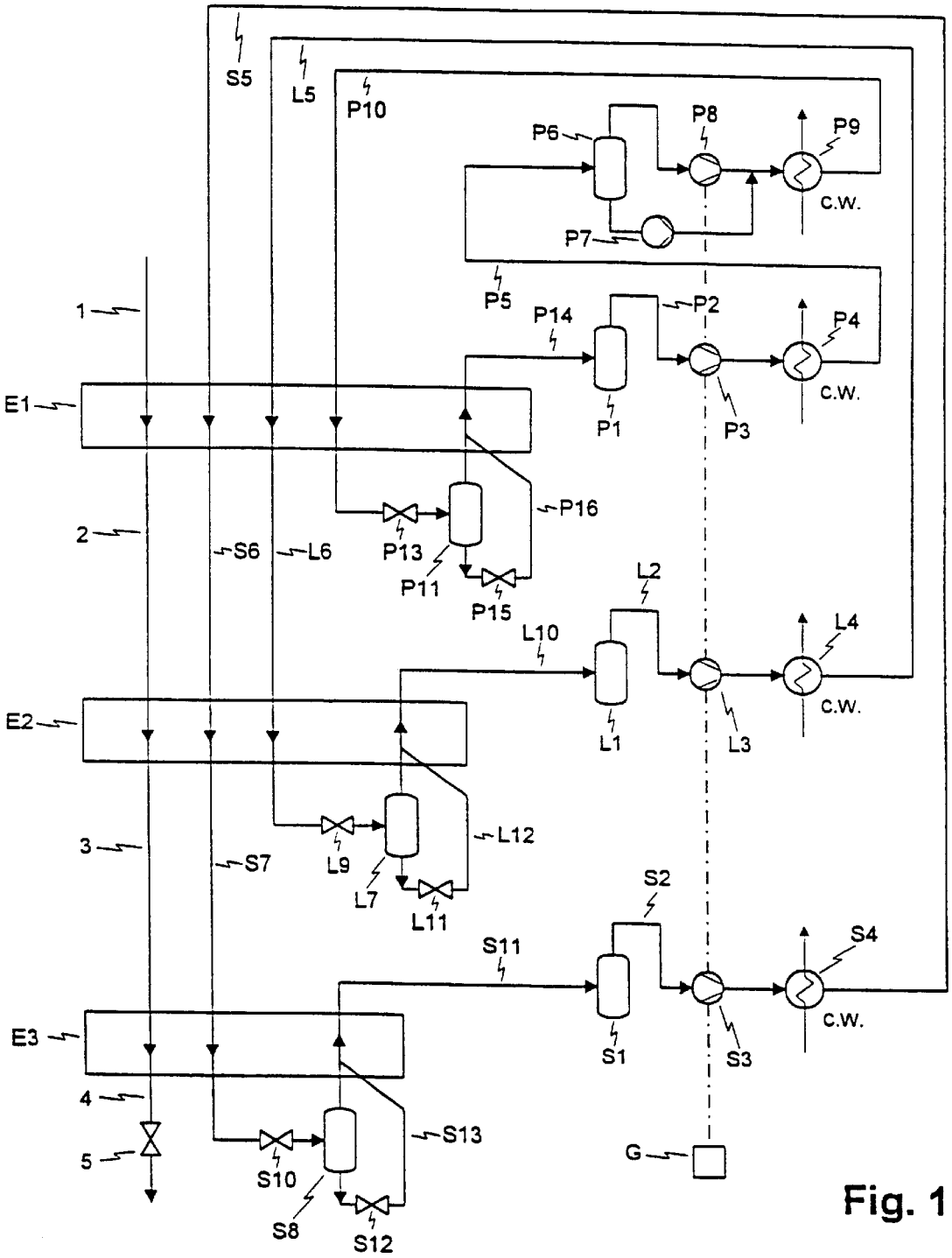

According to the process shown in FIG. 1, an optionally pretreated natural gas stream which has a temperature between 10 and 40° C. and a pressure between 30 and 70 bar is fed via line 1 to a first heat exchanger E1. In this heat exchanger E1, the natural gas stream is precooled to a temperature between −35 and −55° C. against a mixed refrigerant, expanded in an expansion valve P13, of the first or PRC mixed-refrigerant cycle in line P14.

The mixed refrigerant of the third or SRC mixed-refrigerant cycle is fed to the heat exchanger E1 via line S5 at a temperature between 10 and 40° C. and a pressure between 30 and 60 bar and is cooled and partially condensed in the heat exchanger E1 against the abovementioned mixed refrigerant in line P14, the mixed refrigerant vaporizing in line P14 at a pressure between 2 and 6 bar. The mixed refrigerant of the SRC mixed-refrigerant cycle leaves the heat exchanger E1 via line S6 at a temperature between −35 and −55° C.

The mixed refrigerant of the second or LRC mixed-refrigerant cycle is fed to the heat exchanger E1 via line L5 at a temperature between 10 and 40° C. and a pressure between 15 and 25 bar and is condensed in the heat exchanger E1 against the mixed refrigerant of the PRC mixed-refrigerant cycle in line P14. The mixed refrigerant of the LRC mixed-refrigerant cycle is taken off from the heat exchanger E1 at a temperature between −35 and −55° C.

The vaporized and superheated mixed refrigerant of the PRC mixed-refrigerant cycle in line P14 essentially comprises, according to an advantageous development of the process according to the invention, 0 to 40 mol % ethylene or ethane, 30 to 40 mol % propane and 20 to 30 mol % butane. This mixed refrigerant is fed to the separator P1 at a pressure of 2 to 6 bar. The gaseous mixed refrigerant taken off at the top of the separator P1 via line P2 is compressed in the compressor P3 to a pressure between 6 and 10 bar. The compressed mixed refrigerant is subsequently cooled in the cooler P4 to a temperature between 10 and 40° C., preferably against sea water, against air, or against a suitable coolant medium.

Subsequently thereto, the mixed refrigerant is fed via line P5 to a further separator P6. The gaseous fraction of the mixed refrigerant produced at the top of the separator P6 is fed to the second compressor stage P8 and compressed in this to a pressure between 10 and 20 bar. The liquid fraction from the separator P6 is pumped by the pump P7, preferably a centrifugal pump, to a pressure between 10 and 20 bar and subsequently combined with the mixed-refrigerant stream compressed in the compressor P8.

The mixed refrigerant of the first or PRC mixed-refrigerant cycle is preferably compressed in a two-stage single-casing centrifugal compression apparatus which comprises both the cooler P4 and the separator P6. In the case of very high volumes, instead of the centrifugal compression apparatus, an axial compression apparatus can alternatively be provided.

The compressed mixed refrigerant of the PRC mixed-refrigerant cycle is condensed in the cooler P9, preferably against sea water or a corresponding coolant medium, and slightly subcooled to a temperature range of 10 to 40° C. The mixed refrigerant is subsequently fed via line P10 to the heat exchanger E1 and subcooled in this against itself to a temperature between −35 and −50° C.

The vaporization temperature which can be achieved according to the Joule-Thomson expansion in the expansion valve P13—or alternatively thereto in an expansion turbine—is essentially dependent on the degree of subcooling prior to the expansion and on the vaporization pressure in the temperature range between −38 and −53° C.

The second or LRC mixed-refrigerant cycle serves, as already mentioned at the outset, to liquefy the precooled natural gas stream in line 2. The mixed refrigerant of this LRC mixed-refrigerant cycle essentially consists of a mixture of 5 to 15 mol % methane, 0 to 80 mol % ethylene or ethane and 10 to 20 mol % propane. The precooled natural gas stream is fed to the heat exchanger E2 via line 2, cooled in this to a temperature between −80 and −100° C. and subsequently taken off from the heat exchanger E2 via line 3.

The mixed refrigerant of the third or SRC mixed-refrigerant cycle is fed to the heat exchanger E2 via line S6 at a temperature between −35 and −50° C. and condensed against the refrigerant of the LRC mixed-refrigerant cycle in line L10. The mixed refrigerant in line L10 vaporizes to a pressure level between 1.5 and 6 bar. The cooled mixed refrigerant of the SRC mixed-refrigerant cycle is taken off from the heat exchanger E2 via line S7 at a temperature between −80 and −100° C.

The vaporized and superheated mixed refrigerant of the LRC mixed-refrigerant cycle in the line L10 is fed to the separator L1 at a pressure between 1.5 and 6 bar. The gaseous mixed refrigerant produced at the top of the separator L1 is fed via line L2 to the compressor L3 and compressed in this to a pressure between 10 and 20 bar. The compressor E3 is preferably designed as a single-casing axial or centrifugal compressor. Cold-intake compressors of this type have the advantage that the intake medium does not need to be heated up to ambient temperature prior to intake, which saves heating area and thus the heat exchangers can be made smaller and manufactured more cheaply.

The compressed mixed refrigerant of the LRC mixed-refrigerant cycle is cooled in the cooler L4 to a temperature between 10 and 40° C., preferably against sea water or a corresponding coolant medium. The mixed refrigerant taken off from the cooler L4 via line L5 is, as already mentioned, liquefied in the heat exchanger E1, fed via line L6 to the heat exchanger E2 and subcooled in this to a temperature between −80 and −100° C. against itself. The vaporization temperature of the mixed refrigerant according to the Joule-Thomson expansion in the expansion valve L9—or alternatively thereto in an expansion turbine—is between −82 and −112° C.

The third or SRC mixed-refrigerant cycle serves for subcooling the liquefied hydrocarbon-rich stream or natural gas stream. This subcooling is expedient or necessary in order that no more than the required amount of the flash gas is produced after the expansion of the liquefied hydrocarbon-rich stream in a down-stream nitrogen removal unit.

The mixed refrigerant of the third or SRC mixed-refrigerant cycle, according to a further advantageous development of the process according to the invention, essentially consists of a mixture of 0 to 10 mol % nitrogen, 40 to 65 mol % methane and 0 to 40 mol % ethylene or 0 to 30 mol % ethane.

The liquefied hydrocarbon-rich stream fed to the heat exchanger E3 via line 3 is subcooled in the heat exchanger E3 to a temperature of −150 to −160° C. After this subcooling, the hydrocarbon-rich stream or natural gas stream is taken off via line 4 from the heat exchanger E3 and expanded essentially to atmospheric pressure by means of a Joule-Thomson expansion in expansion valve 5—or alternatively thereto in an expansion turbine.

The mixed refrigerant of the third or SRC mixed-refrigerant cycle fed to the heat exchanger E3 via line S9 is subcooled in the heat exchanger E3 and is subsequently likewise subjected to a Joule-Thomson expansion in expansion valve S10. Instead of expansion valve S10, again an expansion turbine can be provided. The expansion in expansion valve S10 is performed to a pressure level between 2 and 6 bar. The vaporization of the mixed refrigerant in heat exchanger E3 serves both for subcooling the already liquefied hydrocarbon-rich stream and for the self-subcooling of the as yet unexpanded mixed refrigerant of the SRC mixed-refrigerant cycle.

The vaporized and superheated mixed refrigerant of the SRC mixed-refrigerant cycle is fed via line S11 to a separator S1. The gaseous mixed refrigerant produced at the top of the separator S1 is fed via line S2 to a compressor S3. In compressor S3, the mixed refrigerant is compressed to a pressure between 35 and 60 bar. The mixed refrigerant exiting from the compressor S3 is subsequently cooled in the cooler S4, preferably against sea water or a suitable coolant medium.

Each of the three mixed-refrigerant cycles has, in accordance with a further advantageous development of the process according to the invention, a separator/storage vessel P11, L7 or S8 downstream of the respective expansion valve P13, L9 or S10. In principle, these separators/storage vessels can also be provided at any other suitable point of the mixed-refrigerant cycles.

The liquid fraction is taken off via lines P16, L12 or S13 from these separators/storage vessels P11, L7 and S8 and fed to the respective vaporous top fraction (flash gas) of the mixed refrigerant. This procedure ensures a good distribution of liquid and gas and thus good heat transfer in the heat exchangers E1, E2 and E3, in particular if these are what are known as plate-fin-type heat exchangers.

Control valves P15, L11 and S12 are provided in lines P16, L12 and S13. These control valves serve for regulating the liquid level within the separators/storage vessels P11, L7 or S8.

In the event that the plant is shut down, the control valves P15, L11 and S12 are closed, so that the separators/storage vessels P11, L7 and S8 are filled with the mixed refrigerant of the respective mixed-refrigerant cycle; for this purpose it is expedient that control valves—which are not shown in the FIGS. 1 to 5—are additionally provided at the top of the separators/storage vessels P11, L7 and S8. This enables the mixed refrigerant to be stored at the coldest point of the respective mixed-refrigerant cycle, as a result of which the start-up procedure is accelerated during reoperation. The separators/storage vessels P11, L7 and S8 are preferably dimensioned such that they can store the total volume of mixed refrigerant of a mixed-refrigerant cycle.

Figure 2:
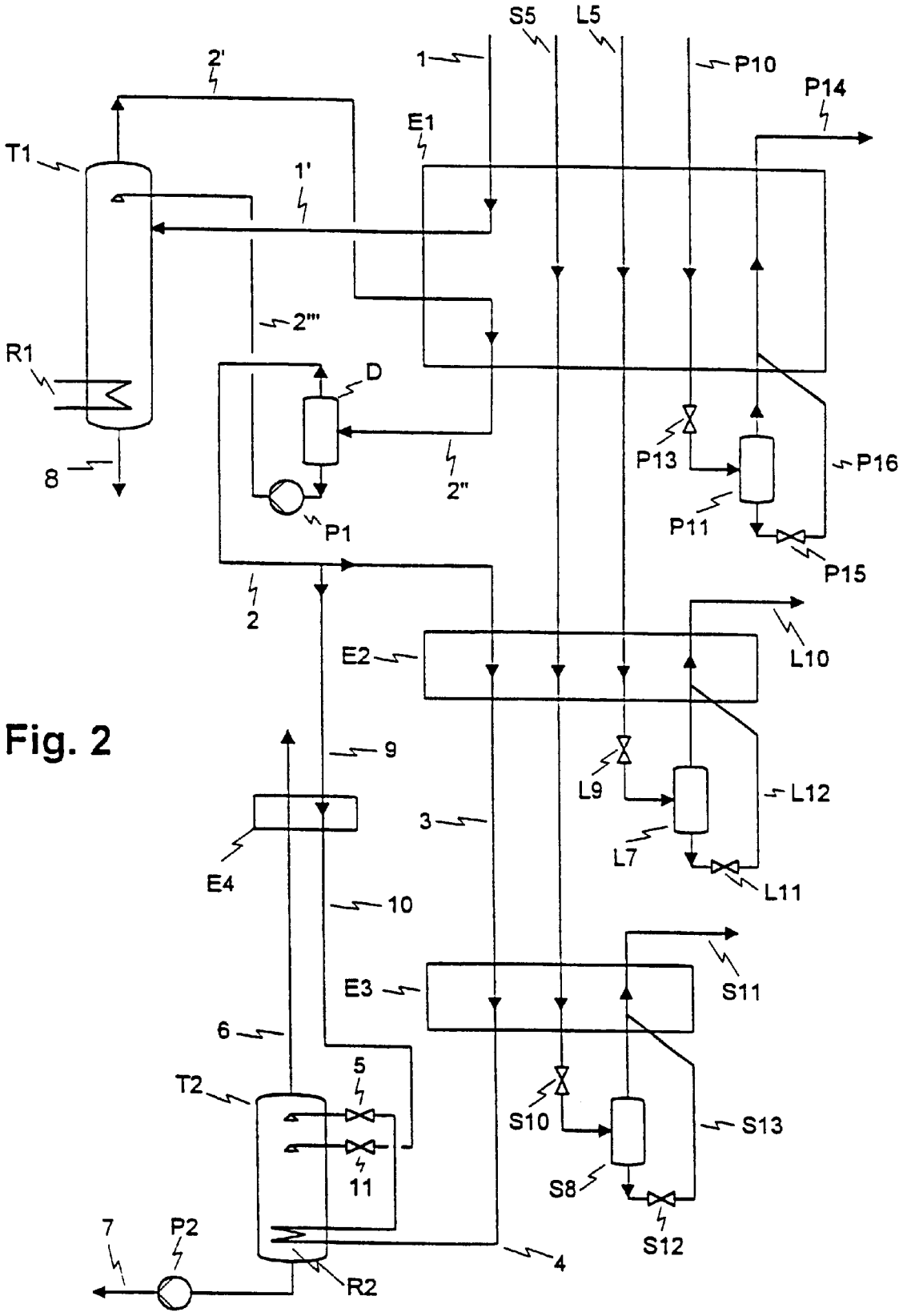
Figure 3:
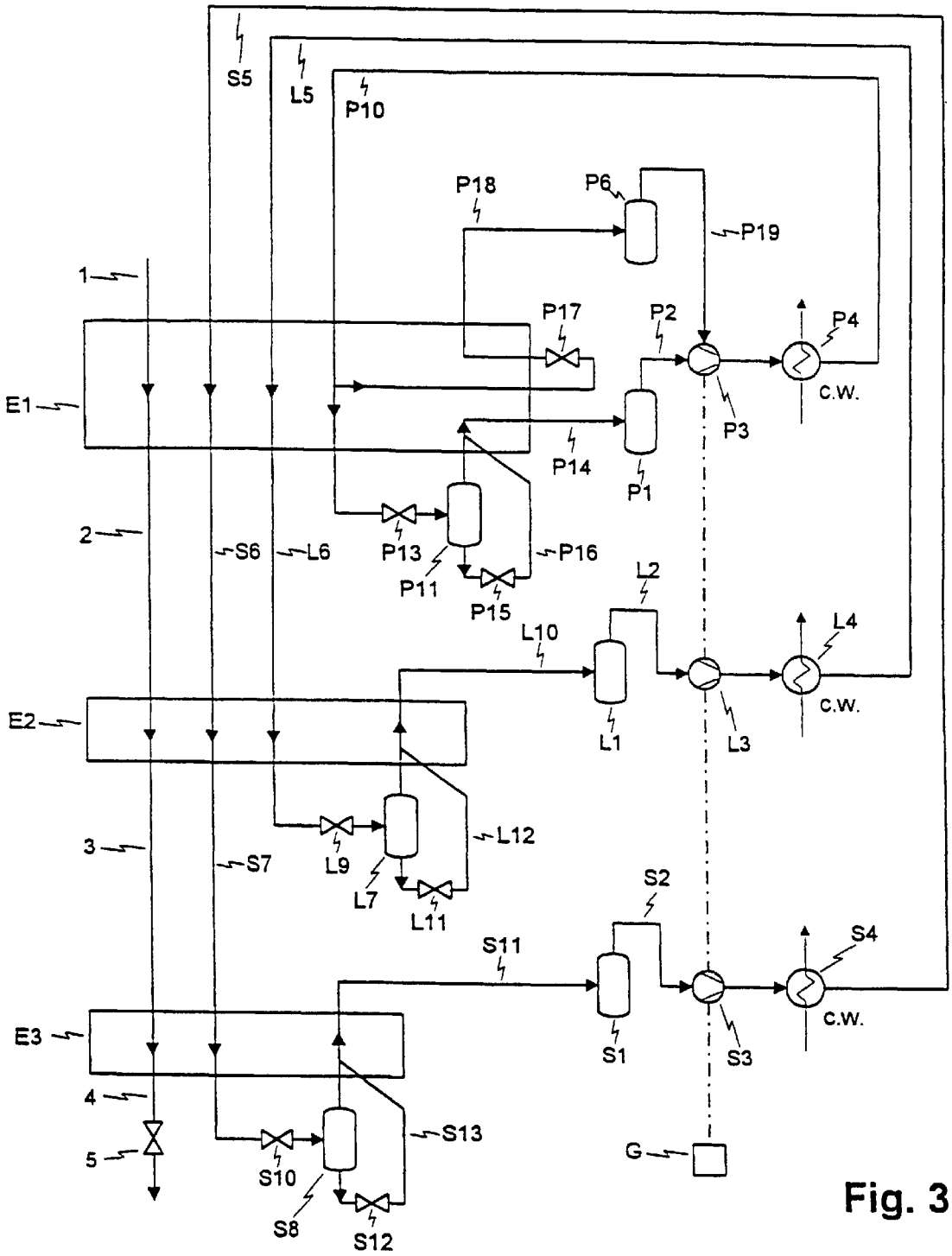
Figure 4:
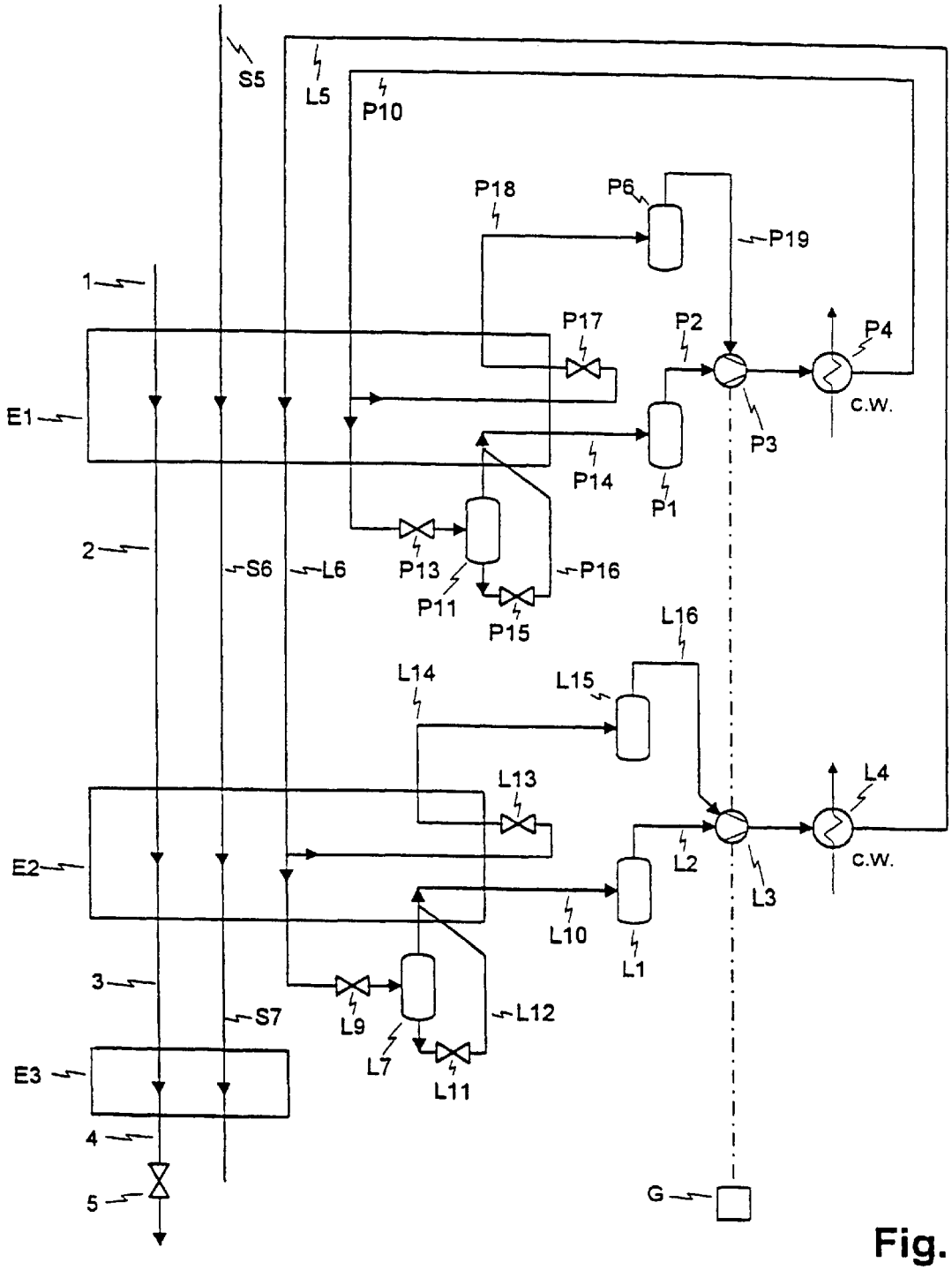
Figure 5:
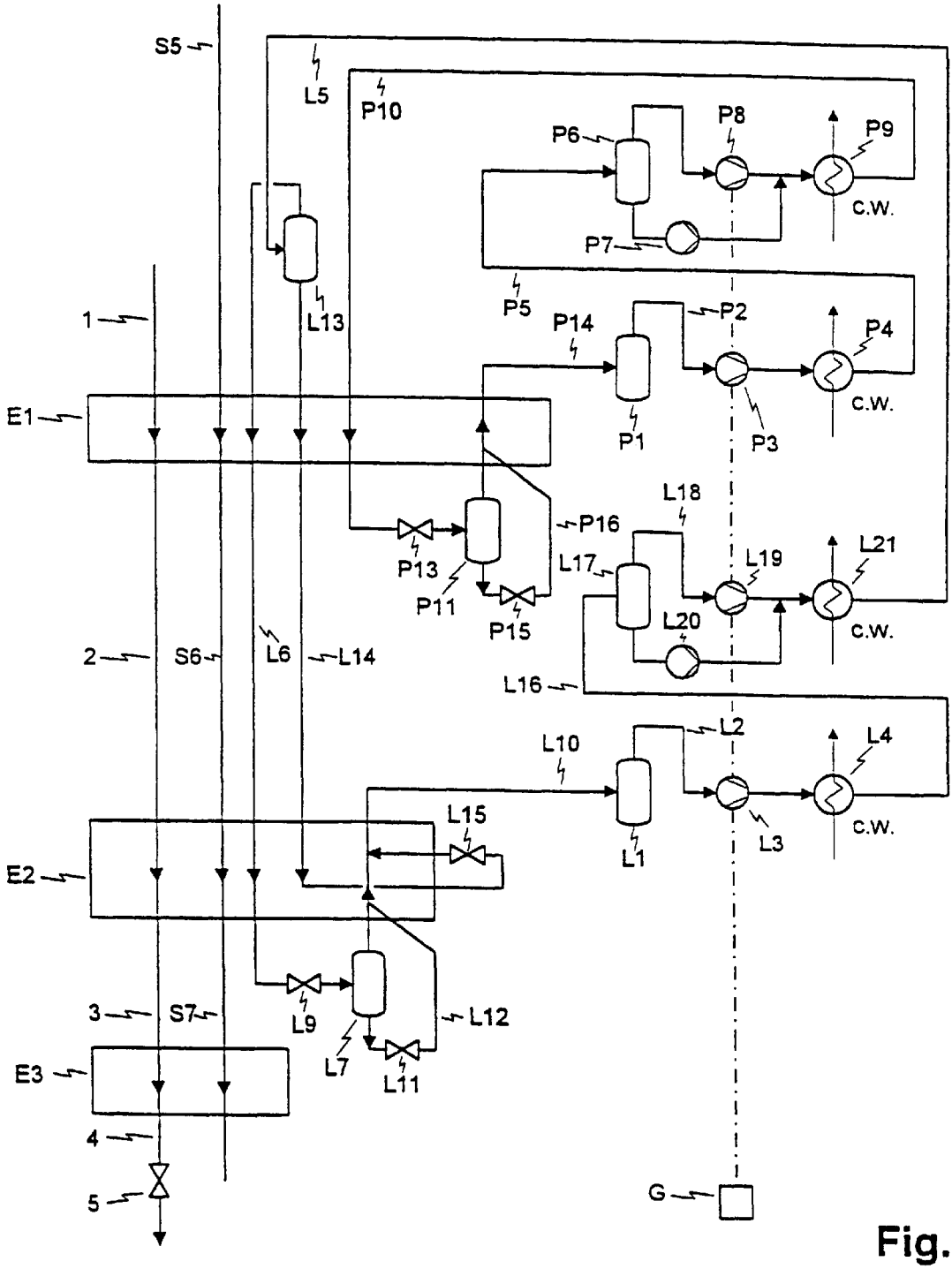

In a development of the process according to the invention, it is proposed that the compressors P8, P3, L3 and S3 are driven by only one gas turbine drive G; this is shown by the dash-dotted line (note: even if, in FIGS. 3 to 5, the designations of the compressors or compressor stages are changed with respect to FIGS. 1 and 2, the dash-dotted line is intended to make it clear that only one compressor drive is required in these developments of the process according to the invention.).

FIG. 2 shows a liquefaction process for natural gas which is essentially identical to that of FIG. 1. The first, second and third or PRC, LRC and SRC mixed-refrigerant cycles, for the sake of clarity, are shown only in part, however.

The hydrocarbon-rich stream or natural gas stream to be liquefied is fed via line 1 to the heat exchanger E1. At an appropriately chosen temperature level, it is taken off via line 1' from the heat exchanger E1 and fed to a separation column T1 which has a reboiler R1. This separation column T1 serves to separate off heavy hydrocarbons, which are taken off via line 8 at the bottom of the separation column T1.

The natural gas which is depleted in heavy hydrocarbons and arises at the top of the separation column T1 is in turn fed via line 2' to the heat exchanger E1. In this, it is further cooled and fed as part-condensed stream via line 2" to a separator D. The liquid fraction arising at the bottom of the separator D is added as reflux to the top of the separation column T1 by means of the pump P1 via line 2"'. The hydrocarbon-rich fraction produced at the top of the separator is fed via line 2 to the heat exchanger E2 and liquefied in this. The liquefied hydrocarbon-rich stream subsequently passes via line 3 to the heat exchanger E3, in which it is subcooled.

The subcooled liquefied hydrocarbon-rich stream is subsequently fed via line 4 to the separation column T2, it being conducted through the column bottom phase, for the purpose of heating the reboiler R2, prior to the expansion in expansion valve 5.

The separation column T2 serves for separating off nitrogen and methane, a stream rich in these two components being taken off at the top of the separation column T2 via line 6. This nitrogen- and methane-rich stream—known as the tail gas—taken off via line 6 is warmed in heat exchanger E4 against a partial stream of the hydrocarbon-rich stream which is taken off at the top of the separator D and is fed via line 9 to the heat exchanger E4. The hydrocarbon-rich partial stream which is liquefied in the course of this is subsequently likewise added to separation column T2 via line 10 and expansion valve 11—either at the same plate or at any plate below the feed point of the hydrocarbon-rich stream in line 4.

The liquefied and subcooled natural gas taken off from the bottom phase of the separation column T2 is fed to storage via line 7 by pump P2.

FIG. 3 shows a further advantageous development of the process according to the invention. In this embodiment the first or PRC mixed-refrigerant cycle is modified with respect to the embodiment shown in FIG. 1. The LRC and SRC mixed-refrigerant cycles, in contrast, are identical to those as shown in FIG. 1.

The compressed (P3) mixed refrigerant is cooled to a temperature between 10 and 40° C. in cooler P4 and liquefied in the course of this. It is subsequently fed via line P10 to heat exchanger E1 and subcooled in this. A partial stream of the subcooled mixed refrigerant is expanded in expansion valve P13—or alternatively thereto in an expansion turbine—and vaporized again in heat exchanger E1. Subsequently, this mixed-refrigerant partial stream is fed via line P14 to the separator P1 at a pressure of 2 to 6 bar. The gaseous mixed refrigerant taken off via line P2 at the top of separator P1 is compressed to a pressure between 6 and 10 bar in compressor P3.

A second partial stream of the liquefied and subcooled mixed refrigerant is taken off at a higher temperature level from the heat exchanger E1 and expanded in expansion valve P17—or alternatively thereto in an expansion turbine. For the sake of clarity, the separator/storage vessel which can be provided downstream of the expansion valve P17 and the corresponding control valves are not shown in the figure. After expansion in P17, this partial stream of the mixed refrigerant is likewise vaporized in the heat exchanger E1 and fed via line P18 to the separator P6. The gaseous mixed refrigerant taken off at the top of the separator P6 via line P19 is likewise fed to the compressor P3 at an intermediate pressure stage.

After mixing and compression of the two described mixed-refrigerant partial streams to approximately 15 to 20 bar in the compressor P3, the compressed mixed refrigerant is cooled and liquefied in the cooler P4 at a temperature between 10 and 40° C., preferably against seawater, against air or against an appropriate coolant medium.

This embodiment of the process according to the invention has the advantages and disadvantages below in comparison with the embodiment shown in FIG. 1:

The enthalpy-temperature diagram of the mixed-refrigerant stream to be vaporized and warmed of the PRC mixed-refrigerant cycle can be adapted better to the enthalpy-temperature diagrams of all streams to be cooled (natural gas stream, PRC, LRC and SRC mixed-refrigerant cycle). The very large gas stream on the suction side of the compressor P3 is divided into two streams. This requires additional piping and control apparatus. The dimensions of the piping are smaller, however. Overall, the energy consumption of this embodiment of the process according to the invention is lower.

FIGS. 4 and 5 show further advantageous developments of the process according to the invention. In these embodiments, the first or PRC mixed-refrigerant cycle and/or the second or LRC mixed-refrigerant cycle are modified in comparison with the embodiment shown in FIG. 1. In contrast, the SRC mixed-refrigerant cycle is identical to those shown in FIGS. 1 and 3. For the sake of clarity, therefore, the SRC mixed-refrigerant cycle is not shown in entirety.

In the case of the embodiment shown in FIG. 4, in addition, the first or PRC mixed-refrigerant cycle is identical to that shown in FIG. 3.

The compressed, and subsequently cooled in cooler L4 to a temperature between 10 and 40° C., mixed refrigerant of the second or LRC mixed-refrigerant cycle is firstly fed via line L5 to the heat exchanger E1 and liquefied in this. Subsequently, the mixed refrigerant is fed via line L6 to the heat exchanger E2 and subcooled in this. A partial stream of the subcooled mixed refrigerant is expanded in expansion valve L9—or alternatively thereto in an expansion turbine—and vaporized in heat exchanger E2. This mixed-refrigerant partial stream is subsequently fed via line L10 to the separator L1. The gaseous mixed refrigerant taken off at the top of the separator L1 via line L2 is compressed in the compressor L3 to a pressure between 10 and 20 bar.

A second partial stream of the subcooled mixed refrigerant of the LRC mixed-refrigerant cycle is taken off at a higher temperature level from the heat exchanger E2 and expanded in the expansion valve L13—or alternatively thereto in an expansion turbine. For the sake of clarity, the separator/storage vessel which can be provided downstream of the expansion valve L13 and the corresponding control valves are not shown in the figure. After expansion in L13, this partial stream of the mixed refrigerant is likewise vaporized in heat exchanger E2 and fed via line L14 to separator L15. The gaseous mixed refrigerant taken off at the top of the separator L15 via line L16 is likewise fed to the compressor L3 at an intermediate pressure stage.

After mixing the two described mixed-refrigerant partial streams in the compressor L3, the compressed mixed refrigerant is cooled in cooler L4 to a temperature between 10 and 40° C., preferably against seawater, against air or against an appropriate coolant medium.

This embodiment of the process according to the invention has the advantages and disadvantages below in comparison with the embodiment shown in FIGS. 1 and 3:

In this case also, the enthalpy-temperature diagrams of the streams to be cooled and warmed can be better adapted to one another. Whether the energy savings which can be achieved by this embodiment of the process according to the invention justify the extra expenditure for the more complex process procedure and plant must be investigated for each individual case.

In the case of the embodiment of the process according to the invention shown in FIG. 5, only the second or LRC mixed-refrigerant cycle is modified in comparison with the embodiment shown in FIG. 1.

The mixed refrigerant which is compressed and subsequently cooled and partially liquefied in cooler L21 to a temperature between 10 and 40° C. is firstly fed via line L5 to a separator L13. The gaseous fraction of the mixed refrigerant is taken off at the top of the separator L13 via line L6, liquefied in heat exchanger E1 and subcooled in heat exchanger E2. Subsequently, the mixed refrigerant is expanded in expansion valve L9—or alternatively thereto in an expansion turbine—and vaporized in heat exchanger E2, after which it is fed via line L10 to the separator L1.

The liquid fraction of the mixed refrigerant is taken off from the bottom of the separator L13 via line L14, subcooled in the heat exchanger E1 and brought to a less low temperature level in the heat exchanger E2. Subsequently, this liquefied and subcooled mixed-refrigerant partial stream is expanded in expansion valve L15—or alternatively thereto in an expansion turbine—likewise vaporized in heat exchanger E2 and admixed to the vaporized mixed-refrigerant partial stream in line L10. For the sake of clarity, the separator/storage vessel which can be provided downstream of the expansion valve L15 and the corresponding control valves are not shown in FIG. 5.

The gaseous mixed refrigerant which is taken off at the top of the separator L1 via line L2 is compressed in the compressor L3 to a pressure between 8 and 10 bar. Subsequently, the compressed mixed refrigerant is cooled in cooler L4 to a temperature between 10 and 40° C., preferably against seawater, against air or against a suitable coolant medium.

Subsequently thereto, the mixed refrigerant is fed via line L16 to a further separator L17. The gaseous fraction of the mixed refrigerant produced at the top of the separator L17 is fed via line L18 to the second compressor stage L19 and compressed in this to a pressure of between 12 and 25 bar. The liquid fraction from the separator L17 is pumped to a pressure between 12 and 25 bar by the pump L20, preferably a centrifugal pump, and is subsequently combined with the mixed-refrigerant stream compressed in compressor L19.

The mixed refrigerant of the second or LRC mixed-refrigerant cycle is preferably compressed in a two-stage single-casing centrifugal compression apparatus which comprises both the cooler L4 and the separator L17. In the case of very high volumes, instead of the centrifugal compression apparatus, an axial compression apparatus can alternatively be provided.

This embodiment of the process according to the invention has the advantages and disadvantages below in comparison with the embodiment shown in FIGS. 1, 2 and 3:

In the case of the embodiment of the process according to the invention shown in FIG. 5, also, the enthalpy-temperature diagrams of the streams to be cooled and warmed can be better adapted to one another. Whether the energy savings which can be achieved by this embodiment justify the additional expenditure for the more complex process procedure or plant must again be investigated for each individual case.

In some circumstances it can be expedient to provide the compressors and drives shown in FIGS. 1 to 5 in a liquefaction plant twice (e.g. 2* 50%). By means of the redundancy resulting from this, even in the event of a fault in one machine, at least 50% of the production is maintained.

What is claimed is:

1. A process for liquefying a hydrocarbon-rich stream by indirect heat exchange with the refrigerants of a mixed-refrigerant cascade cycle, wherein the mixed-refrigerant cascade cycle comprises at least 3 mixed-refrigerant cycles having different refrigerant compositions, the first of the 3 mixed-refrigerant cycles serves for precooling (E1), the second mixed-refrigerant cycles serves for liquefying (E2) and the third mixed-refrigerant cycles serves for subcooling (E1) the hydrocarbon-rich stream(1) to be liquefied, characterized in that the mixed-refrigerants are subcooled and either work expanded or subjected to Joule-Thomson expansion, and the resultant cooled gas is heated in indirect heat exchange with said hydrocarbon-rich stream, and the resultant vaporized mixed refrigerants are compressed at temperatures less than ambient temperature by at least two of the three cold-intake compressors (P3, L3, S3) each compressor compressing a different mixed refrigerant.

2. Process for liquefying a hydrocarbon-rich stream according to claim 1, characterized in that the first of the 3 mixed-refrigerant cycles serves for precooling (E1), the second mixed-refrigerant cycle serves for liquefying (E2) and the third mixed-refrigerant cycle serves for subcooling (E3) the hydrocarbon-rich stream (1) to be liquefied.

3. Process for liquefying a hydrocarbon-rich stream according to claims 2, characterized in that the mixed refrigerant of the first of the 3 mixed-refrigerant cycles (P5, P10, . . . ) essentially comprises 0 to 40 mol % ethylene or ethane, 30 to 40 mol % propane and 20 to 30 mol % butane.

4. Process for liquefying a hydrocarbon-rich stream according to 2, characterized in that the mixed refrigerant of the second of the 3 mixed-refrigerant cycles (L5, L6, . . . ) essentially comprises 5 to 15 mol % methane, 0 to 80 mol % ethylene or ethane and 10 to 20 mol % propane.

5. Process for liquefying a hydrocarbon-rich stream according to claim 2, characterized in that the mixed refrigerant of the third of the 3 mixed-refrigerant cycles (S5, S6, . . . ) essentially comprises 0 to 10 mol % nitrogen, 40 to 65 mol % methane and 0 to 40 mol % ethylene or 0 to 30 mol % ethane.

6. Process for liquefying a hydrocarbon-rich stream according to claim 2, characterized in that the precooling (E1), the liquefaction (E2) and the subcooling (E3) of the hydrocarbon-rich stream (1) to be liquefied is performed in at least 3 heat exchangers (E1, E2, E3) and the expanded mixed refrigerant of each of the 3 mixed-refrigerant cycles is fed merely through the last heat exchanger (E1, E2 or E3) prior to the next compression (P3, L3, S3).

7. Process for liquefying a hydrocarbon-rich stream according to claim 1, characterized in that the compressors (P3, L3, S3) used for compressing the mixed refrigerants are driven by only one drive apparatus (G), in particular a gas turbine drive apparatus.

8. Process for liquefying a hydrocarbon-rich stream according to claim 1, characterized in that, in the event of a stoppage of the plant or process, at least the mixed refrigerant of one of the mixed-refrigerant cycles is or are temporarily stored in at least one separator/storage vessel (P11, L7, S8) which is or are preferably arranged at the coldest point of each mixed-refrigerant cycle.

9. Process for liquefying a hydrocarbon-rich stream according to claim 3, characterized in that the mixed refrigerant of the first of the 3 mixed-refrigerant cycles (P5, P10, . . . ) essentially comprises 0 to 40 mol % ethylene or ethane, 30 to 40 mol % propane and 20 to 30 mol % butane.

10. A process for liquefying a hydrocarbon-rich stream according to claim 3, characterized in that the mixed refrigerant of the first of the 5 mixed-refrigerant cycles (P5, P10, . . . ) essentially comprises 0 to 40 mol % ethylene or ethane, 30 to 40 mol % propane and 20 to 30 mol % butane.

11. A process according to claim 1 wherein prior to compression at below ambient temperatures, the expanded mixed refrigerants are passed directly into a separator to provide a vapor depleted of liquid, and the resultant vapor is passed directly to said cold-intake compressor.

12. A process according to claim 1 wherein the hydrocarbon-rich stream is a natural gas stream.

13. A process according to claim 11 wherein the hydrocarbon-rich stream is a natural gas stream.

14. A process according to claim 7 wherein the drive apparatus is a gas turbine gas apparatus.

15. A process according to claim 8 wherein the at least one separator or storage vessel is arranged at the coldest point of each mixed-refrigerant cycles.

16. In a process for liquefying a hydrocarbon-rich stream, by indirect heat exchange with the refrigerants of a mixed-refrigerant cascade cycle, wherein the mixed-refrigerant cascade cycle comprises at least 3 mixed-refrigerant cycles having different refrigerant compositions, the improvement wherein the compressors (P3, L3, S3) used for compressing the mixed refrigerant are driven by only one drive apparatus.

17. A process according to claim 16 wherein drive apparatus is a gas turbine system.

18. A process according to claim 17 wherein the hydrocarbon-rich stream is a natural gas stream.

* * * * *